US011383945B2

(12) United States Patent
Kanno

(10) Patent No.: US 11,383,945 B2
(45) Date of Patent: Jul. 12, 2022

(54) IMAGE FORMING APPARATUS THAT CONTROLS FEEDING OPERATION

(71) Applicant: CANON KABUSHIKI KAISHA, Tokyo (JP)

(72) Inventor: Naoki Kanno, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 16/440,869

(22) Filed: Jun. 13, 2019

(65) Prior Publication Data

US 2020/0002115 A1 Jan. 2, 2020

(30) Foreign Application Priority Data

Jun. 29, 2018 (JP) ..... JP2018-125008

(51) Int. Cl.

*B65H 7/18* (2006.01)
*B65H 1/08* (2006.01)
*B65H 7/06* (2006.01)

(52) U.S. Cl.

CPC ..... *B65H 7/18* (2013.01); *B65H 1/08* (2013.01); *B65H 7/06* (2013.01); *B65H 2511/529* (2013.01)

(58) Field of Classification Search

CPC ..... B65H 7/18; B65H 7/06; B65H 2511/414
See application file for complete search history.

(56) References Cited

U.S. PATENT DOCUMENTS

| | | | | |
|---|---|---|---|---|
| 7,748,694 | B2 * | 7/2010 | Matsumoto | B65H 7/02 271/10.03 |
| 9,020,372 | B2 * | 4/2015 | Yako | G03G 15/5012 399/19 |
| 9,296,580 | B2 * | 3/2016 | Sung | H04N 1/00652 |
| 10,214,372 | B2 * | 2/2019 | Okubo | B65H 3/0684 |
| 10,308,452 | B2 * | 6/2019 | Sugano | G03G 15/70 |

FOREIGN PATENT DOCUMENTS

| | | | |
|---|---|---|---|
| JP | 2003-306251 | A | 10/2003 |
| JP | 2004-280076 | A | 10/2004 |
| JP | 2007-98603 | A | 4/2007 |
| JP | 2011-75794 | A | 4/2011 |

* cited by examiner

*Primary Examiner* — Patrick Cicchino
(74) *Attorney, Agent, or Firm* — Canon U.S.A., Inc. I.P. Division

(57) ABSTRACT

An image forming apparatus includes a detection unit to detect recording material fed from a stacking unit, a determination unit, a count unit, and a control unit. The determination unit determines that a feeding failure has occurred when the detection unit does not detect the recording material until elapse of a predetermined period. The count unit counts a number of times the feeding operation is performed for a single sheet of the recording material. When the counted number of feeding operation performance times by when the feeding failure has occurred is smaller than a threshold, the control unit restarts the feeding operation that has been stopped without waiting for a user's operation. When the counted number of feeding operation performance times by when the feeding failure has occurred is at least equal to the threshold, the control unit waits for the user's operation while the feeding operation is stopped.

10 Claims, 7 Drawing Sheets

IMAGE FORMING APPARATUS THAT CONTROLS FEEDING OPERATION

BACKGROUND

Field

The present disclosure relates to an operation in the case in which a recording material remains inside an image forming apparatus, such as a copier or a printer.

Description of the Related Art

In known image forming apparatuses, such as a copier and a printer, a recording material may remain inside during feeding operation in some cases. In the case in which such a feeding failure (hereinafter referred to as a jam) occurs, it is necessary to remove the remaining recording material from inside the apparatus.

Japanese Patent Laid-Open No. 2004-280076 describes an image forming apparatus including a sheet feeding roller that feeds sheets of paper from a cassette to a conveying path and a sensor that is placed on the conveying path and detects sheets. In the case in which the sensor does not detect any sheet of paper for a period from when the sheet feeding operation is started by the sheet feeding roller to when a predetermined period elapses since, the image forming apparatus determines that a sheet feeding delay jam has occurred.

The sheet feeding delay jam occurs when, for example, the sheet feeding roller cannot properly feed a sheet of paper placed on the cassette because the sheet feeding roller slips. In this case, if a user does not remove the sheet of paper by opening a cover of the image forming apparatus, the sheet remaining inside the apparatus may be automatically output by the image forming apparatus rotating again, for example, the sheet feeding roller. In this respect, Japanese Patent Laid-Open No. 2004-280076 describes a control in which, only in the case in which a sheet feeding delay jam has occurred, the image forming apparatus automatically recovers from a jam without waiting for a user's operation for the image forming apparatus, such as an operation for opening the cover. With such a control, the user does not need to open the cover, and thus, the usability of the image forming apparatus is improved.

However, sheets cannot be always output automatically when a sheet feeding delay jam occurs. For example, when a sheet of paper is changed in an accordion fold shape in the conveying path at a position between a cassette and a sensor and jammed at the position, the sheet cannot be automatically discharged from the apparatus. Hence, when using the control described in Japanese Patent Laid-Open No. 2004-280076, remaining sheets cannot be removed in some cases and the image forming apparatus thus cannot recover from the jam.

SUMMARY

According to an aspect of the present disclosure, an image forming apparatus includes a stacking unit configured to stack a recording material, a feeding unit configured to feed the recording material stacked on the stacking unit, a detection unit configured to detect the recording material fed by the feeding unit, a determination unit configured to determine that a feeding failure has occurred when the detection unit does not detect the recording material until a time when a predetermined period elapses since the feeding unit has started a feeding operation for the recording material, a count unit configured to count a number of times the feeding operation is performed for a single sheet of the recording material, and a control unit configured to control the feeding operation for the recording material and to stop the feeding operation when the determination unit determines that the feeding failure has occurred, wherein, in a case in which the number of times the feeding operation is performed that is counted by the count unit by a time when the feeding failure has occurred is smaller than a threshold, the control unit restarts the feeding operation that has been stopped without waiting for a user's operation for the image forming apparatus, and wherein, in a case in which the number of times the feeding operation is performed that is counted by the count unit by the time when the feeding failure has occurred is equal to or greater than the threshold, the control unit waits for the user's operation for the image forming apparatus while the feeding operation is stopped.

Further features of the present disclosure will become apparent from the following description of exemplary embodiments with reference to the attached drawings.

DESCRIPTION OF THE EMBODIMENTS

First Embodiment

Overall Configuration Diagram

Figure 1:
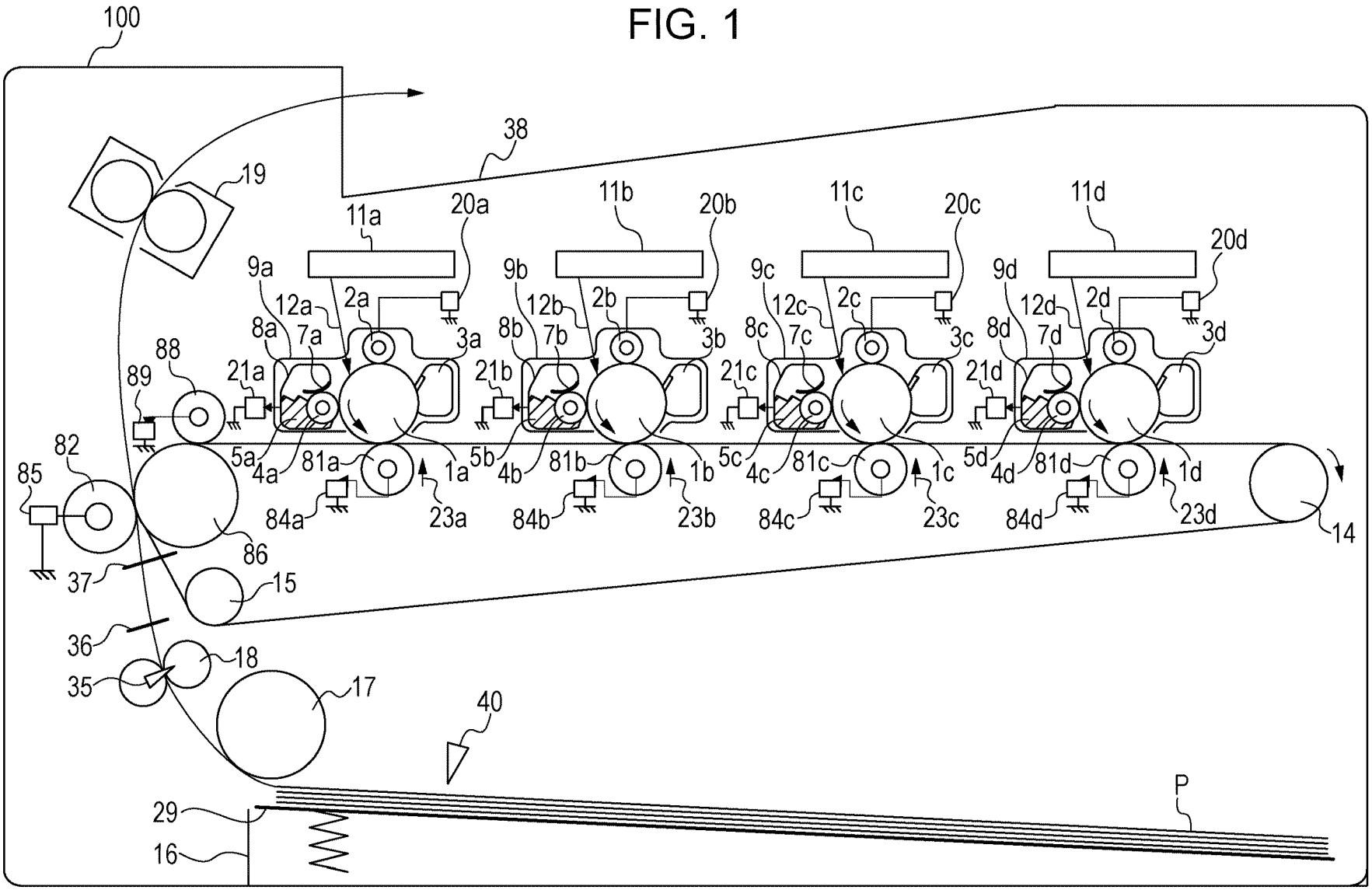
FIG. 1 is an overall configuration diagram of an image forming apparatus.

Referring to FIG. 1, the overall configuration of a color image forming apparatus is described. In this embodiment, a laser beam printer is used as an example of a color image forming apparatus.

Image Forming Section

A laser beam printer 100 (hereinafter referred to as the printer 100) includes four image forming stations. The first station forms yellow (Y) toner images, the second station forms magenta (M) toner images, the third station forms cyan (C) toner images, and the fourth station forms black (K) toner images. Since each image forming station has the same configuration, the configuration of the first station is described here as a representative.

The first station includes a photosensitive drum 1*a*. The photosensitive drum 1*a* is formed by laminating multiple layers of functional organic materials including a carrier generating layer on which electric charges are generated by the light applied to a metal cylinder and a charge transport layer that is used to transport the generated electric charges. The outermost layer of the multiple layers has a low electrical conductivity and is an almost insulating layer. In addition, the first station includes a charging roller 2*a*. The charging roller 2*a* abuts the photosensitive drum 1*a* and charges uniformly the surface of the photosensitive drum 1*a* while being rotated by the rotation of the photosensitive drum 1*a*. A voltage to which a direct current voltage or an alternating current voltage has been added is applied to the charging roller 2*a* and electricity is discharged in fine air gaps positioned upstream and downstream of a contact nip portion between the surface of the charging roller 2*a* and the surface of the photosensitive drum 1*a*, and as a result, the photosensitive drum 1*a* is charged. In addition, the first station includes a development unit 8*a*. The development unit 8*a* is constituted by a development roller 4*a* abutting the photosensitive drum 1*a*, a non-magnetic one-component developer 5*a* (hereinafter referred to as the toner 5*a*), and a developer blade 7*a*. In addition, the first station includes a cleaning unit 3*a*. The cleaning unit 3*a* cleans untransferred toner remaining on the photosensitive drum 1*a*. The photosensitive drum 1*a* to the development unit 8*a* integrally form a process cartridge 9*a* that is attached to a main body of the printer 100 in an attachable and detachable manner. In addition, the first station includes a scanner unit 11*a*. The scanner unit 11*a* applies to the photosensitive drum 1*a* a scanning beam 12*a* modulated in accordance with an image signal. The scanner unit 11*a* may be a light emitting diode (LED) array. In addition, the first station includes a primary transfer roller 81*a*. A charging bias power source 20*a*, a developing bias power source 21*a*, and a primary-transfer bias power source 84*a* are coupled respectively to the charging roller 2*a*, the development roller 4*a*, and the primary transfer roller 81*a* to apply voltage.

The configuration of the first station is as described above and the second, third, and fourth stations all have the same configuration. The components of the second, third, and fourth stations are indicated by respectively adding b, c, or d instead of a after the same numerals as those of the components of the first station.

An intermediate transfer belt 80 is supported by three rollers as stretching members, namely a secondary transfer facing roller 86, a drive roller 14, and a tension roller 15, and as a result, the tension in the intermediate transfer belt 80 is maintained. The intermediate transfer belt 80 loops in the direction indicated by the arrow in FIG. 1 by being driven by the drive roller 14. Discharging members 23*a* to 23*d* are disposed downstream with respect to the respective primary transfer rollers 81*a* to 81*d* in the direction in which the intermediate transfer belt 80 loops. The drive roller 14, the tension roller 15, the discharging members 23*a* to 23*d*, and the secondary transfer facing roller 86 are electrically grounded. A cleaning roller 88 cleans untransferred toner remaining on the intermediate transfer belt 80. A cleaning bias power source 89 is coupled to the cleaning roller 88 to apply voltage.

Next, an image forming process is described. The photosensitive drum 1*a* in the first station is formed by coating the outer circumferential surface of an aluminum cylinder with an organic photoconductive layer (OPC). The photosensitive drum 1*a* is supported by flanges at its both ends in a rotatable manner and rotates in the direction indicated by the arrow in FIG. 1 by the driving force transmitted from a drive motor not illustrated in the drawing to one end of the photosensitive drum 1*a*. The photosensitive drum 1*a* and the intermediate transfer belt 80 moves at substantially the same speed. The charging roller 2*a* is a conductive roller. The charging roller 2*a* abuts the surface of the photosensitive drum 1*a* and charging bias voltage is applied to the charging roller 2*a* by the charging bias power source 20*a*, and as a result, the surface of the photosensitive drum 1*a* is uniformly charged. The scanner unit 11*a* includes a polygon mirror to which a beam of light corresponding to an image signal is applied by a laser diode not illustrated in the drawing. In this manner, the scanner unit 11*a* forms an electrostatic latent image on the photosensitive drum 1*a*. The development roller 4*a*, which abuts the photosensitive drum 1*a*, is rotated by the drive of a drive motor not illustrated in the drawing and voltage is applied to the development roller 4*a* by the developing bias power source 21*a*, and as a result, the development roller 4*a* supplies the yellow toner 5*a* to the photosensitive drum 1*a*. In this manner, the development roller 4*a* forms a toner image on the photosensitive drum 1*a*. Following the same image forming process, toner images are formed on photosensitive drums 1*b* to 1*d* in the second, third, and fourth stations. As described above, a magenta toner image is formed on the photosensitive drum 1*b*, a cyan toner image is formed on the photosensitive drum 1*c*, and a black toner image is formed on the photosensitive drum 1*d*. The primary transfer rollers 81*a* to 81*d* are disposed on the inner side of the intermediate transfer belt 80 such that the primary transfer rollers 81*a* to 81*d* are in contact with the intermediate transfer belt 80 while respectively facing the four photosensitive drums 1*a* to 1*d*. By applying voltage to the primary transfer rollers 81*a* to 81*d* from primarily-transfer bias power sources 84*a* to 84*d*, negatively charged toner images formed on the photosensitive drums 1*a* to 1*d* are transferred in series on the intermediate transfer belt 80. In this manner, a color toner image is formed on the intermediate transfer belt 80.

Sheet Feeding Conveyance Section

Multiple sheets of paper P (recording materials) are placed on a cassette 16 (a stacking unit). When the sheets of paper P are fed from the cassette 16, firstly, the cassette bottom plate 29 is lifted up by driving a lift-up motor (not illustrated), and as a result, the sheets of paper P placed on the cassette 16 are lifted up. When a sheet plane sensor 40 detects the sheets of paper P, the lift-up operation accordingly ends. The topmost sheet of the sheets of paper P that have been lifted up comes into contact with a pickup roller 17 and the sheets of paper P are individually fed by the rotation of the pickup roller 17. A registration sensor 35 detects the leading edge of the sheet of paper P that is fed. Here, the leading edge of the sheet of paper P denotes the edge positioned downstream in the transport direction of the sheet of paper P. Conveying the sheet of paper P continues for a predetermined period after the registration sensor 35 detects the leading edge of the sheet of paper P, and when the leading edge of the sheet of paper P reaches a temporary stop position 36, conveying the sheet of paper P is suspended.

Subsequently, conveying the sheet of paper P that has been fed by the pickup roller 17 is restarted by a registration roller 18. The registration roller 18 conveys the sheet of paper P to a secondary transfer position so as to match the leading edge of the image formed on the intermediate transfer belt 80 with the leading edge of the sheet of paper P at a merge point 37. The secondary transfer position is a contact portion between a secondary transfer roller 82 and the intermediate transfer belt 80. A secondary-transfer bias power source 85 is coupled to the secondary transfer roller 82 to apply voltage. When the sheet of paper P is conveyed, by applying voltage to the secondary transfer roller 82, an electric field is formed between the secondary transfer roller 82 and the secondary transfer facing roller 86 that are placed to face each other and dielectric polarization occurs between the intermediate transfer belt 80 and the sheet of paper P. This causes electrostatic attraction force between the intermediate transfer belt 80 and the sheet of paper P. As a result, the toner image formed on the intermediate transfer belt 80 is transferred to the sheet of paper P.

Fixing Section

A fixing unit 19 applies heat and pressure to the sheet of paper P and fixes the transferred toner image on the sheet of paper P. The fixing unit 19 includes a fixing belt and an elastic pressure roller. While the fixing belt is sandwiched between the elastic pressure roller and a belt guide member not illustrated in the diagram, the elastic pressure roller and the belt guide member form a fixing nip portion of a given length to cause a given level of contact pressure at the fixing nip portion. In the state in which the temperature of the fixing nip portion is adjusted to a predetermined temperature, the sheet of paper P on which the unfixed toner image is formed is conveyed to the fixing nip portion between the fixing belt and the elastic pressure roller. At this time, the sheet of paper P enters the fixing nip portion such that the image plane faces upward, that is, faces the fixing belt, and is conveyed in a sandwiched manner along with the fixing belt through the fixing nip portion while the image plane is in close contact with the outer surface of the fixing belt. In the process in which the sheet of paper P is conveyed in a sandwiched manner along with the fixing belt through the fixing nip portion, heat is applied to the sheet of paper P at the fixing belt, and as a result, the toner image that has been unfixed is fixed on the sheet of paper P by the heat. Subsequently, the sheet of paper P on which the toner image is fixed is output to an output tray 38 from the fixing unit 19.

Control Block Diagram

Figure 2:
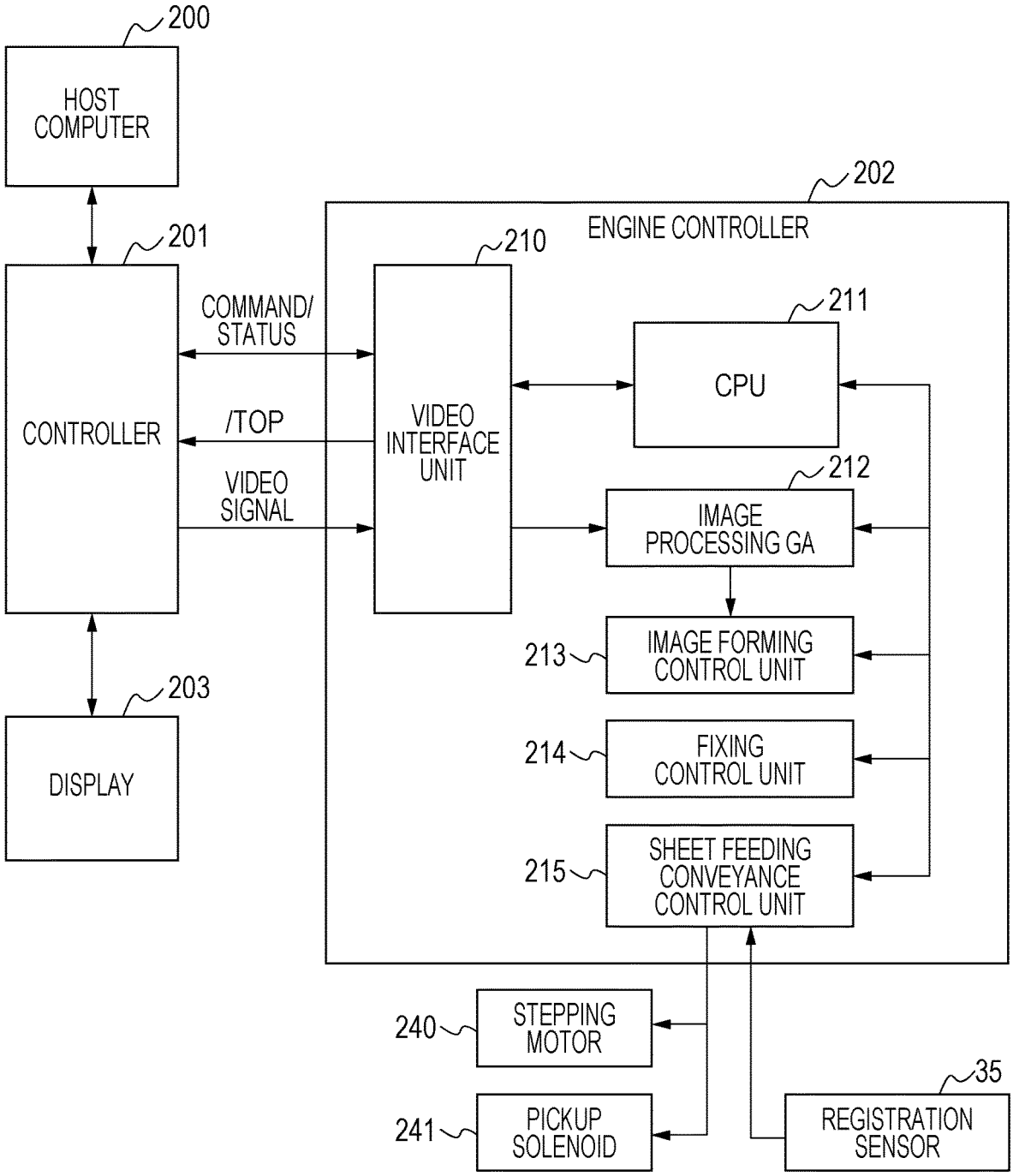
FIG. 2 is a control block diagram of the image forming apparatus.

FIG. 2 is a block diagram illustrating a system configuration of the printer 100. A controller 201 is configured to execute mutually communicate with a host computer 200 and an engine controller 202. The controller 201 receives image information and a print instruction from the host computer 200, analyzes the received image information, and converts the image information into bit data. The controller 201 then transmits for each sheet of paper P a print start instruction and a video signal to a central processing unit (CPU) 211 and an image processing GA 212 via a video interface unit 210.

The controller 201 transmits to the CPU 211 via the video interface unit 210 information about print color mode selection (information about monochrome printing or color printing) according to the print instruction transmitted from the host computer 200. When printing can be started, the controller 201 transmits the print start instruction to the CPU 211 via the video interface unit 210. The CPU 211 prepares for printing in accordance with the information transmitted from the controller 201 and waits for the print start instruction transmitted from the controller 201. When receiving the print start instruction, the CPU 211 instructs control units (an image forming control unit 213, a fixing control unit 214, and a sheet feeding conveyance control unit 215) to start printing operation in accordance with the printing condition determined by the controller 201.

When receiving an instruction for starting printing operation, the image forming control unit 213 starts preparing for image forming. When notified by the image forming control unit 213 that the preparation for image forming is completed, the CPU 211 outputs to the controller 201 a /TOP signal that indicates a basic time at which a video signal is output. When receiving the /TOP signal from the CPU 211, the controller 201 outputs video signals corresponding to the respective colors at the basic time indicated by the /TOP signal. When receiving the video signals from the controller 201, the image processing GA 212 transmits image forming data to the image forming control unit 213. The image forming control unit 213 forms an image in accordance with the image forming data received from the image processing GA 212.

When receiving the instruction for starting printing operation, the sheet feeding conveyance control unit 215 starts a sheet feeding operation (a feeding operation). The sheet feeding conveyance control unit 215 causes the pickup roller 17 to rotate by rotating a stepping motor 240 as a sheet feeding motor by using a motor-driver integrated circuit (IC) not illustrated in the drawing and then starting a pickup solenoid 241 after a predetermined period. In this manner, the sheet of paper P is fed from the cassette 16. The sheet feeding conveyance control unit 215 stops conveying the sheet of paper P in a temporary manner at the time when the leading edge of the sheet of paper P reaches the temporary stop position 36 in accordance with e time when the registration sensor 35 detects the leading edge of the sheet of paper P that is fed. The CPU 211 projects, in accordance with the /TOP signal as the basic time, the time when the position of the leading edge of the toner image formed on the intermediate transfer belt 80 reaches the merge point 37. The CPU 211 instructs the sheet feeding conveyance control unit 215 to restart the temporary stopped conveyance of the sheet of paper P in such a manner as to not miss the projected time. The sheet feeding conveyance control unit 215 accordingly restarts conveying the sheet of paper P in response to the instruction for restarting the conveyance of the sheet of paper P as a result, the toner image can be transferred to the desired or predetermined position of the sheet of paper P.

When the registration sensor 35 does not detect the leading edge of the sheet of paper P for a period from when the sheet feeding operation is started by the pickup roller 17 to when a predetermined period elapses since, the sheet feeding conveyance control unit 215 determines that a sheet feeding failure (a feeding failure) has occurred. The sheet feeding failure that has occurred here is a sheet feeding delay jam. The sheet feeding conveyance control unit 215 notifies the controller 201 of sheet feeding failure information via the video interface unit 210. The controller 201 displays on a display 203, which is, for example, an operation panel, information that needs to be reported to a user on the basis of the sheet feeding failure information received from the engine controller 202.

When receiving the instruction for starting printing operation, the fixing control unit 214 starts preparing for fixing. The fixing control unit 214 starts adjusting the temperature in accordance with printing information to not miss the time when the sheet of paper P on which the toner image has been transferred is conveyed to the fixing control unit 214. The fixing control unit 214 fixes the toner image on the sheet of paper P and then outputs the sheet of paper P to the output tray 38.

Feeding Failure Cases

The sheet feeding failure described above, that is, the sheet feeding delay jam is described in detail. The sheet feeding delay jam is divided into the following three cases.

The first case: the state in which the sheet of paper P is fed by the pickup roller 17 from the cassette 16 to the conveying path, but the leading edge of the sheet of paper P the leading edge of the sheet of paper P stops in the conveying path at a position beyond the cassette 16 and cannot reach the registration sensor 35 (the shape of the sheet of paper P is not changed).

The second case: the sheet of paper P placed on the cassette 16 cannot be properly picked up by the pickup roller 17 and remains in the cassette 16 (the shape of the sheet of paper P is not changed).

The third case: the leading edge of the sheet of paper P is stuck in the conveying path at a position before the registration sensor 35 and the sheet of paper P is jammed in a changed shape.

The first case is caused by the decrease in conveying force due to the abrasion of the pickup roller 17. The conveying force of the pickup roller 17 is affected by the type of the sheet of paper P placed on the cassette 16. The third case is likely to occur when the leading edge of the sheet of paper P placed on the cassette 16 is folded.

It is considered that the second case is caused when, for example, the sheet of paper P is not placed at a proper position on the cassette 16. For example, the position of the trailing edge guide plate that guides the position of the trailing edge of the sheet of paper P is inappropriate. As another cause, it is considered that a user may stack on the cassette 16 the sheets of paper P more than a predetermined number (overstacking). Among these cases of sheet feeding delay jam, the second case that is caused by the user's erroneous operation is most likely to occur in the market.

Among these cases, in the third case, to restart the printing operation and the sheet feeding operation performed by the printer 100, the user needs to remove the sheet of paper P from inside the apparatus. This is because the shape of the jammed sheet of paper P is changed and the sheet of paper P thus cannot be automatically output from the apparatus. By contrast, in the first and second cases, since the shape of the sheet of paper P is not changed, the sheet of paper P may be automatically output to outside the apparatus. When the sheet of paper P can be automatically output to outside the apparatus, the printer 100 can restart the printing operation and the sheet feeding operation without the user's operation for removing the sheet of paper P from inside the apparatus.

Since the known image forming apparatuses cannot distinguish these three cases from each other, the known image forming apparatuses notifies the user of the occurrence of sheet feeding failure in every case and every time displays for the user on the display 203 a message indicating that the sheet inside the apparatus should be removed. In other words, the known image forming apparatuses suggest the user's operation performed for the printer 100 also in the first and second cases in which the printer 100 can automatically recover without the user's operation for removing the sheet of paper P, and as a result, the usability is reduced. Especially in the second case, since no sheet of paper P stops in the conveying path, the user cannot find the sheet of paper P to be removed when opening a cover or the cassette 16 of the printer 100. As a result, the usability is reduced.

Similarly, to the known image forming apparatuses, the printer 100 according to this embodiment also cannot distinguish the three cases from each other, but the printer 100 calculates which case has occurred in accordance with the number of times the sheet had been fed until the sheet feeding failure occurred and determines whether the user's recovery operation is necessary. When it is determined that the user's recovery operation is unnecessary, the printer 100 notifies the user of only the event in which the sheet feeding failure has occurred and does not provide the user with a message for suggesting the user's operation for the printer 100, such as a message indicating that the sheet inside the apparatus should be removed. Subsequently, the printer 100 automatically returns to the normal condition. When it is determined that the user's recovery operation is necessary, the printer 100 notifies the user of the event in which the sheet feeding failure has occurred and provides the user with the message for suggesting the user's operation for the printer 100. Subsequently, the printer 100 waits for the user's recovery operation.

Timing Charts of Normal Image Forming Control

Figure 3A:
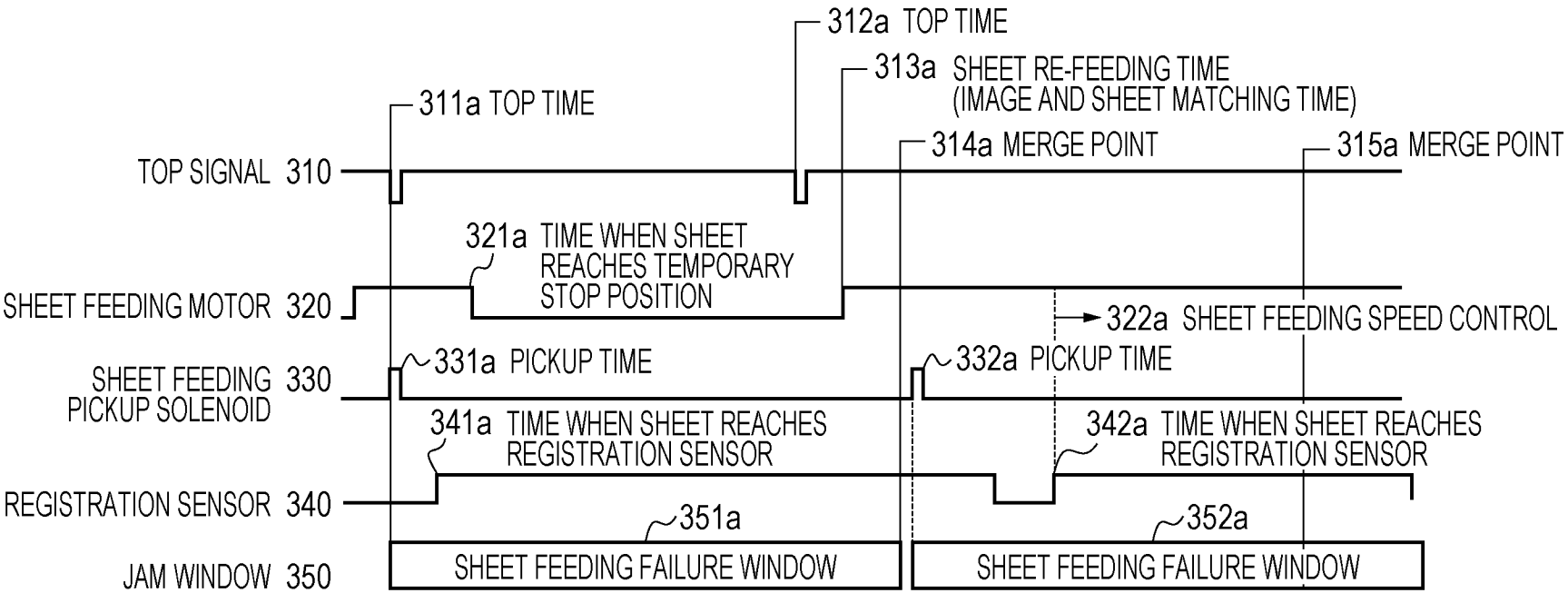
FIGS. 3A to 3C are timing charts of image forming operation.
Figure 3B:
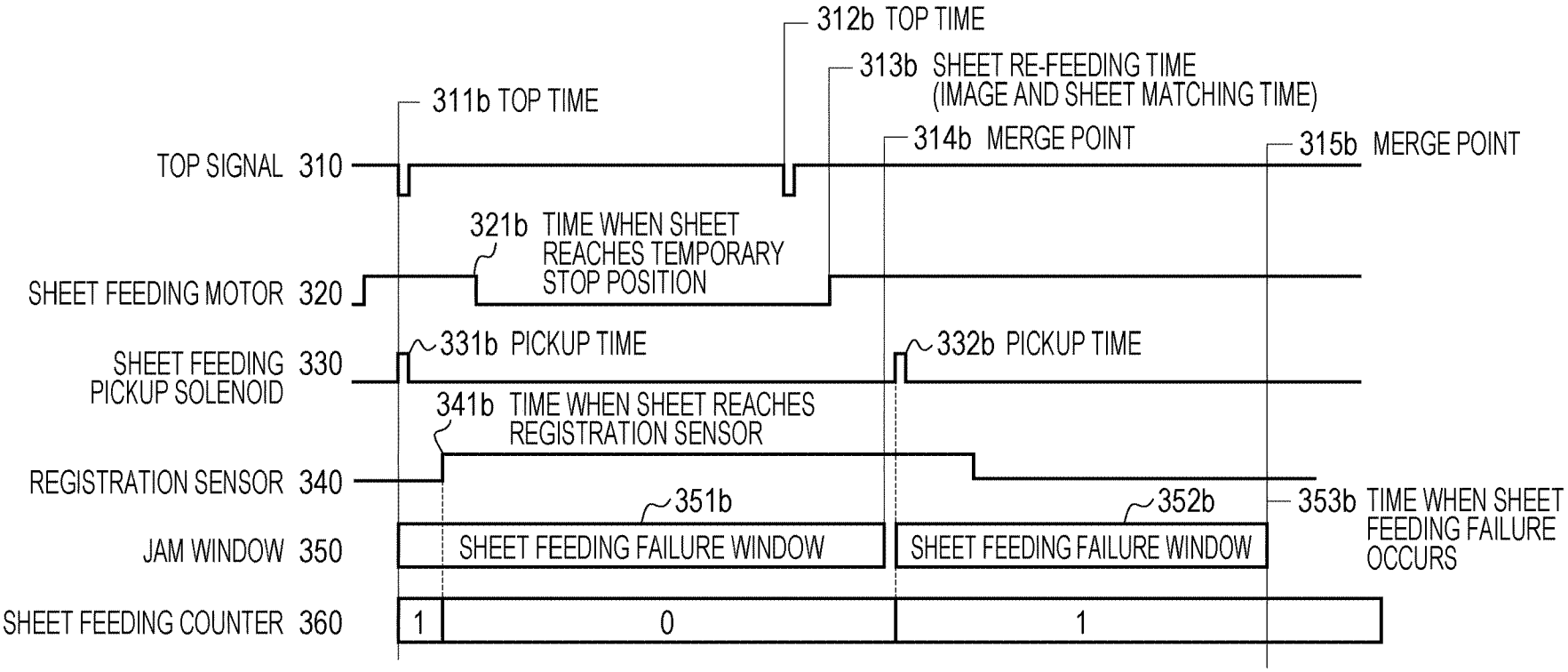
Figure 3C:
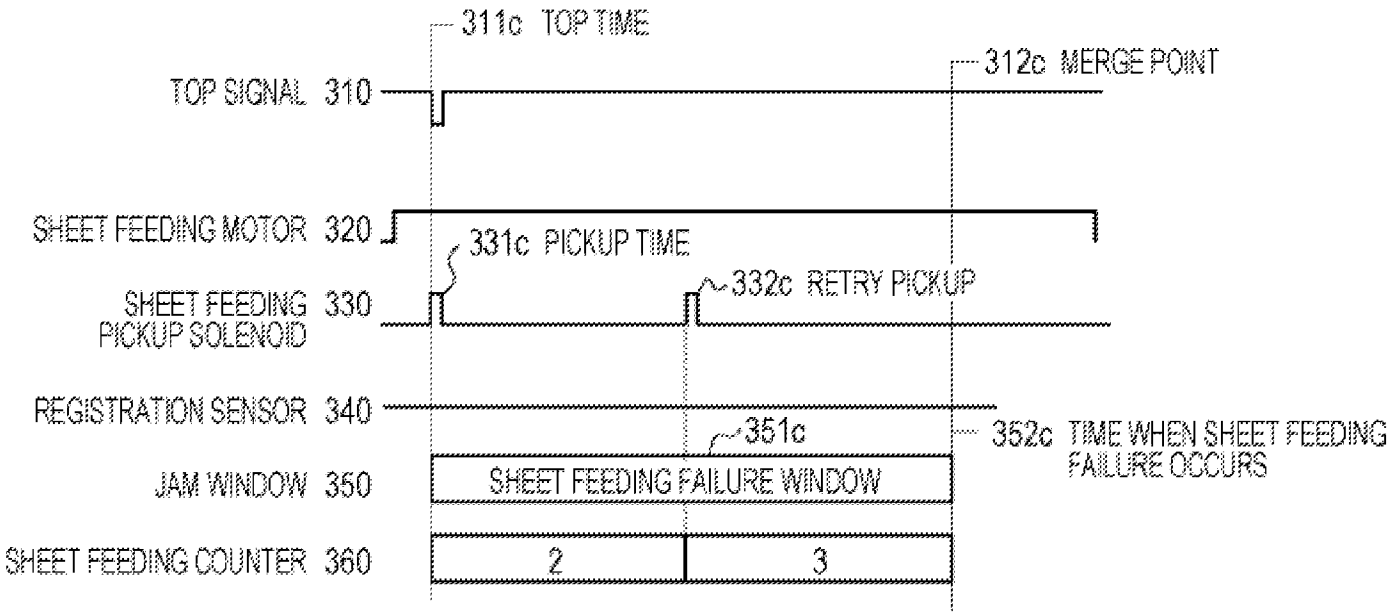

FIGS. 3A to 3C are timing charts of image forming performed by the printer 100 according to this embodiment. Firstly, referring to FIG. 3A, the normal image forming control is described.

When receiving a print start instruction from the controller 201, the engine controller 202 starts preparing for image forming. After the preparation is completed, the engine controller 202 outputs a /TOP signal (311*a*) to the controller 201. When receiving the /TOP signal (311*a*), the controller 201 outputs video signals corresponding to yellow, magenta, cyan, and black, which are not illustrated in the timing chart, and forms images. In the case in which the engine controller 202 receives multiple print start instructions from the controller 201, the engine controller 202 outputs a subsequent /TOP signal (312*a*) in accordance with the image size and the image interval.

A sheet feeding motor (320) is driven at the time when the engine controller 202 receives a print start instruction from the controller 201. Subsequently, a sheet feeding pickup solenoid (330) is driven for a predetermined period (331*a*) and the sheet of paper P placed on the cassette 16 is fed. The registration sensor 35 detects the leading edge of the sheet of paper P that is being fed (341*a*), and the engine controller 202 then controls the sheet of paper P to be conveyed to the temporary stop position 36 and stops conveying the sheet of paper P at the temporary stop position 36 in a temporary manner (321*a*). The engine controller 202 restarts conveying the sheet of paper P (313*a*) miss the time when the leading edge of the toner image formed on the intermediate transfer belt 80 reaches the merge point 37 (314*a*), and as a result, an image is formed at a desired or predetermined position of the sheet of paper P. With regard to the second and subsequent sheets of paper P, the sheet of paper P is not stopped at the temporary stop position 36, but the engine controller 202 controls the speed of the sheet feeding motor (320) in accordance with the time when the registration sensor 35 detects the leading edge of the sheet of paper P (342*a*). The engine controller 202 accelerate or decelerate (322*a*) the speed of the sheet feeding motor (320) to match the leading edge of the sheet of paper P with the leading edge of the toner image at the merge point 37. Periods of sheet feeding failure window (351*a* and 352*a*) are periods in which the engine controller 202 determines the occurrence of sheet feeding failure. Details of the sheet feeding failure window intervals will be described later.

Timing Chart When Feeding Failure Occurs

FIGS. 3B and 3C are timing charts when a sheet feeding failure occurs. FIG. 3B is a timing chart when a sheet feeding failure occurs in the case in which the sheet feeding counter indicates 1. FIG. 3C is a timing chart when a sheet feeding failure occurs in the case in which the sheet feeding counter indicates 2. Here, the sheet feeding counter counts the number of times the sheet feeding operation is performed by the pickup roller 17.

The image forming operation and the sheet feeding operation for the first sheet of paper is the same as those described with reference to FIG. 3A and the control for the second sheet is described below. At the time when the sheet feeding pickup solenoid is driven in the feeding control, 1 is added to the count of the sheet feeding counter (360). When the leading edge of the sheet of paper P is properly detected by the registration sensor 35, 1 is subtracted from the count of the sheet feeding counter. A jam window (350) corresponds to periods (331*b* to 314*b* and 332*b* to 315*b*), which is from the time when the sheet feeding pickup solenoid is driven in the feeding control to the time when the leading edge of the image formed on the intermediate transfer belt 80 reaches the merge point 37.

The /TOP signal for the second sheet (312*b*) is output after the period corresponding to the image size and the image interval elapses since the /TOP signal for the first sheet (311*b*) has been output. The sheet feeding operation for the second sheet is performed after the period corresponding to the sheet size and the feeding interval elapses since the first sheet has been fed (331*b*). Specifically, the engine controller 202 drives the sheet feeding pickup solenoid for the second sheet for a predetermined period (332*b*), as a result, the second sheet of paper P is fed. At the time of starting the sheet feeding pickup solenoid for the second sheet (332*b*), 1 is added to the count of the sheet feeding counter.

The sheet feeding conveyance control unit 215 then waits until the registration sensor 35 detects the leading edge of the sheet of paper P. In the case in which the registration sensor 35 does not detect the leading edge of the sheet of paper P until the period of the sheet feeding failure window (352*b*) passes, the sheet feeding conveyance control unit 215 determines that a sheet feeding failure has occurred (353*b*) and compares the present value of the sheet feeding counter (360) and a threshold. In this embodiment, the threshold is set as 2. In the case of FIG. 3B, the value of the sheet feeding counter (360) is 1 and the threshold is 2, and therefore, the sheet feeding counter (1)<the threshold (2).

In this case, the sheet feeding conveyance control unit 215 determines that the present case is probably a no pick-up sheet feeding failure, that is, the second case of sheet feeding delay jam, and notifies the controller 201 of the determination result via the video interface unit 210. The determination is made by using the concept as follows. As described above, the second case of sheet feeding failure is most likely to occur in the market. Therefore, in this embodiment, when the value of the sheet feeding counter (360) is 1, it is determined that the second case of sheet feeding failure has occurred.

When receiving the notification about the second case of the sheet feeding failure from the engine controller 202, the controller 201 notifies the user of only the event in which the sheet feeding failure has occurred via the display 203 and automatically performs the recovery operation. At this time, the controller 201 does not provide via the display 203 a message for suggesting the user's operation for the printer 100. The recovery operation here includes, for example, the operation of automatically outputting the sheet of paper P remaining in the apparatus and the operation of cleaning the image formed on the photosensitive drums 1*a* to 1*d* and the intermediate transfer belt 80.

FIG. 3C is a timing chart illustrating the printing operation after a sheet feeding failure has occurred in FIG. 3B and the automatic recovery operation has been accordingly performed. When receiving a /TOP signal (311*c*), the controller 201 starts image forming. The sheet feeding motor (320) starts when a print start instruction is received from the controller 201. The engine controller 202 then drives the sheet feeding pickup solenoid (330) for a predetermined period (331*c*) and causes the sheet of paper P placed on the cassette 16 to be fed.

The sheet feeding conveyance control unit 215 adds 1 to the count of the sheet feeding counter (360) at the time of the sheet feeding operation (331*c*). Afterwards, in the case in which the registration sensor 35 detects the leading edge of the sheet of paper P by the time when a predetermined period elapses, the sheet feeding conveyance control unit 215 sets the value of the sheet feeding counter as 0 and properly performs the printing operation.

Conversely, in the case in which the registration sensor 35 does not detect the leading edge of the sheet of paper P by the time when the predetermined period elapses, the sheet feeding conveyance control unit 215 retries the sheet feeding operation (332*c*). Concerning the first sheet of paper P, since the time spent until the leading edge of the image reaches the merge point 37 is long, there is still enough time after the sheet feeding is succeeded in the sheet feeding operation that is retried. The sheet feeding conveyance control unit 215 adds 1 to the count of the sheet feeding counter (360) at the time of retrying the sheet feeding operation (332*c*). The sheet feeding conveyance control unit 215 then waits until the registration sensor 35 detects the leading edge of the sheet of paper P. In the case in which the registration sensor 35 does not detect the leading edge of the sheet of paper P until the period of a sheet feeding failure window (351*c*) passes, the sheet feeding conveyance control unit 215 determines that a sheet feeding failure has occurred (352*c*) and compares the present value of the sheet feeding counter (360) and the threshold. In the case of FIG. 3C, the value of the sheet feeding counter (360) is 3 and the threshold is 2, and therefore, the sheet feeding counter (3)≥the threshold (2).

In this case, the sheet feeding conveyance control unit 215 determines that the present case is probably the third case of sheet feeding delay jam and notifies the controller 201 of the determination result via the video interface unit 210. The determination is made by using the concept as follows. By the time when the present sheet feeding occurs, the sheet feeding operation has been performed twice. In the case in which a sheet feeding failure occurs after the sheet feeding operation has been performed twice, the sheet feeding failure may be caused by a reason other than no pick-up, such as an issue in the conveying path. Therefore, in this embodiment, when the value of the sheet feeding counter (360) is 2 or more, it is determined that the third case of sheet feeding failure has occurred.

When receiving the notification about the third case of sheet feeding failure from the engine controller 202, the controller 201 notifies, via the display 203, the user of the event in which the sheet feeding failure has occurred and the suggestion for removing the remaining sheet from the conveying path. The user accordingly checks the remaining sheet, and when necessary, removes the remaining sheet, and then instructs, via the display 203, the printer 100 to perform the recovery operation.

Flowchart When Sheet Feeding Failure Occurs

Figure 4:
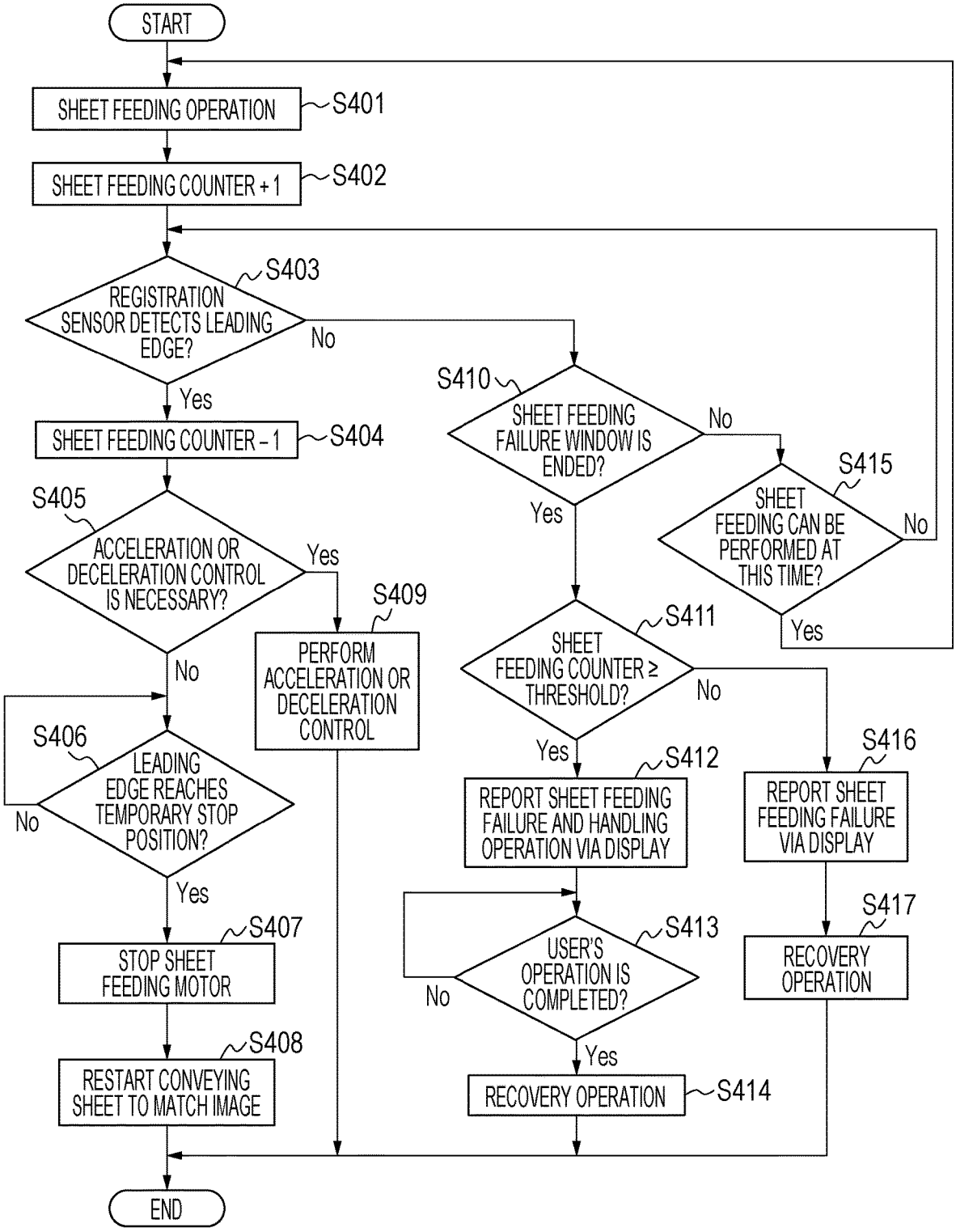
FIG. 4 is a flowchart when a feeding failure occurs in a first embodiment.

FIG. 4 is a flowchart when a feeding failure occurs in this embodiment. The control following the process illustrated as the flowchart in FIG. 4 is performed by the engine controller 202 in accordance with a program stored in a read only memory (ROM) or a random access memory (RAM) that are not illustrated in the drawing.

Firstly, when the print start instruction is received from the controller 201, the CPU 211 instructs the sheet feeding conveyance control unit 215 to perform sheet feeding. The sheet feeding conveyance control unit 215 drives the stepping motor 240, and then drives the pickup solenoid 241 for a predetermined period, and as a result, the sheet of paper P placed on the cassette 16 is fed (S401). The sheet feeding conveyance control unit 215 then adds 1 to the count of the sheet feeding counter (S402). In S403, the sheet feeding conveyance control unit 215 determines whether the registration sensor 35 detects the leading edge of the sheet of paper P.

When the registration sensor 35 detects the leading edge of the sheet of paper P, the sheet feeding conveyance control unit 215 subtracts 1 from the count of the sheet feeding counter in S404. The process then proceeds to S405. In S405, in accordance with the position of the leading edge of the image formed on the intermediate transfer belt 80 and the time when the registration sensor 35 detects the leading edge of the sheet of paper R it is determined whether the sheet feeding conveyance control unit 215 needs to perform acceleration or deceleration control.

In the case in which both the acceleration and deceleration controls are unnecessary, for example, in the case in which the sheet feeding operation is performed for the first sheet, the sheet feeding conveyance control unit 215 causes the sheet of paper P to be conveyed to the temporary stop position (S406) and then stops the stepping motor 240 (S407). The sheet feeding conveyance control unit 215 subsequently restarts conveying the sheet of paper P to not miss the timing of moving the image formed on the intermediate transfer belt 80 (S408). In the case in which the acceleration or deceleration control is necessary, for example, in the case in which the sheet feeding operation is performed for the second or subsequent sheet during continuous printing, the sheet feeding conveyance control unit 215 accelerates or decelerates the speed of the stepping motor 240 and causes the sheet of paper P to be conveyed in such a manner as to not miss the timing of moving the image formed on the intermediate transfer belt 80 (S409).

By contrast, in the case in which it is determined in S403 that the registration sensor 35 does not detect the leading edge of the sheet of paper P, the sheet feeding conveyance control unit 215 checks the sheet feeding failure window in S410. When the period of the sheet feeding failure window has not passed, the sheet feeding conveyance control unit 215 determines in S415 whether sheet feeding can be performed at this time. Whether sheet feeding can be performed at this time is determined in most cases in accordance with whether the pickup roller 17 has rotated one revolution at the time. In the case in which it is determined in S415 that sheet feeding can be performed at this time, the process returns to S401 and the sheet feeding conveyance control unit 215 retries sheet feeding. In the case in which it is determined in S415 that sheet feeding cannot be performed at this time, the process returns to S403 and the sheet feeding conveyance control unit 215 waits again until the leading edge of the sheet of paper P is detected.

In the case in which the registration sensor 35 does not detect the leading edge of the sheet of paper P by the time when it is determined in S410 that the period of the sheet feeding failure window has passed, the sheet feeding conveyance control unit 215 compares the value of the sheet feeding counter and the threshold (S411). In the case in which it is determined in S411 that the value of the sheet feeding counter is equal to or greater than the threshold, the sheet feeding conveyance control unit 215 notifies the controller 201 that the third case of sheet feeding failure has occurred. When receiving the notification of the occurrence of the third case of sheet feeding failure, the controller 201 notifies, via the display 203, the user of the occurrence of sheet feeding failure and suggests to the user checking the remaining sheet in the conveying path and checking the placement condition of the sheet of paper P on the cassette 16 (S412). After performing the necessary operation, the user notifies, via, for example, the display 203, the controller 201 of the completion of the user's operation. The controller 201 checks the completion of the operation (S413) and performs the recovery operation of the printer 100 (S414).

In the case in which it is determined in S411 that the value of the sheet feeding counter is less than the threshold, the sheet feeding conveyance control unit 215 notifies the controller 201 that the second case of sheet feeding failure has occurred. When receiving the notification indicating that the second case of sheet feeding failure has occurred, the controller 201 notifies, via the display 203, the user of the occurrence of sheet feeding failure (S416). The sheet feeding conveyance control unit 215 then automatically performs the recovery operation of the printer 100 (S417).

As described above, in this embodiment, when a sheet feeding failure has occurred, the condition of the sheet remaining inside the apparatus is calculated in accordance with the number of times the sheet feeding operation has been performed in the preceding period and corresponding operations are performed accordingly, and as a result, the usability can be improved/refined.

Second Embodiment

In this embodiment, the threshold is changed in accordance with the type of the sheet of paper P placed on the cassette 16 in the first embodiment. The main part of this embodiment is identical to that of the first embodiment and only the part different from that of the first embodiment is described here.

In the description of the cassette 16 according to the first embodiment, the lift-up operation is mentioned. The lift-up operation is such that the sheet plane sensor 40 measures the position of the sheet plane of the topmost sheet of the sheets of paper P stacked on the cassette 16 and lifting up the cassette bottom plate 29 is accordingly stopped at an appropriate position. In this manner, the level of the sheet plane is maintained at a level appropriate for the sheet feeding operation. In the lift-up operation, the appropriate level cannot be measured when a particular type of the sheet of paper P is placed on the cassette 16.

In the description of the first embodiment, it is assumed to use a sheet of plain paper. In this embodiment, for example, it is assumed to place on the cassette 16 a type of the sheet of paper P that is relatively thick, such as an envelope. When the cassette 16 is opened and then closed, the lift-up operation is performed until the sheet plane sensor 40 enters in an ON state. In the configuration in which the pickup roller 17 is movable, as the result of bringing down the pickup roller 17 into contact with the envelope after the lift-up operation, the level of the sheet plane may be lower than that of plain paper due to the weight of the pickup roller 17 or the thickness of the envelope. This is because the air layer inside the envelope is constricted. When the condition of the sheet plane sensor 40 is changed from the ON state to an OFF state, it is accordingly determined that the level of the sheet plane is lowered. In this situation, the level of the sheet plane is not maintained at an appropriate level, and thus, the printer 100 needs to perform an operation to deal with this condition, such as an additional lift-up operation.

Flowchart of Feeding Control in Accordance with this Embodiment

Figure 5:
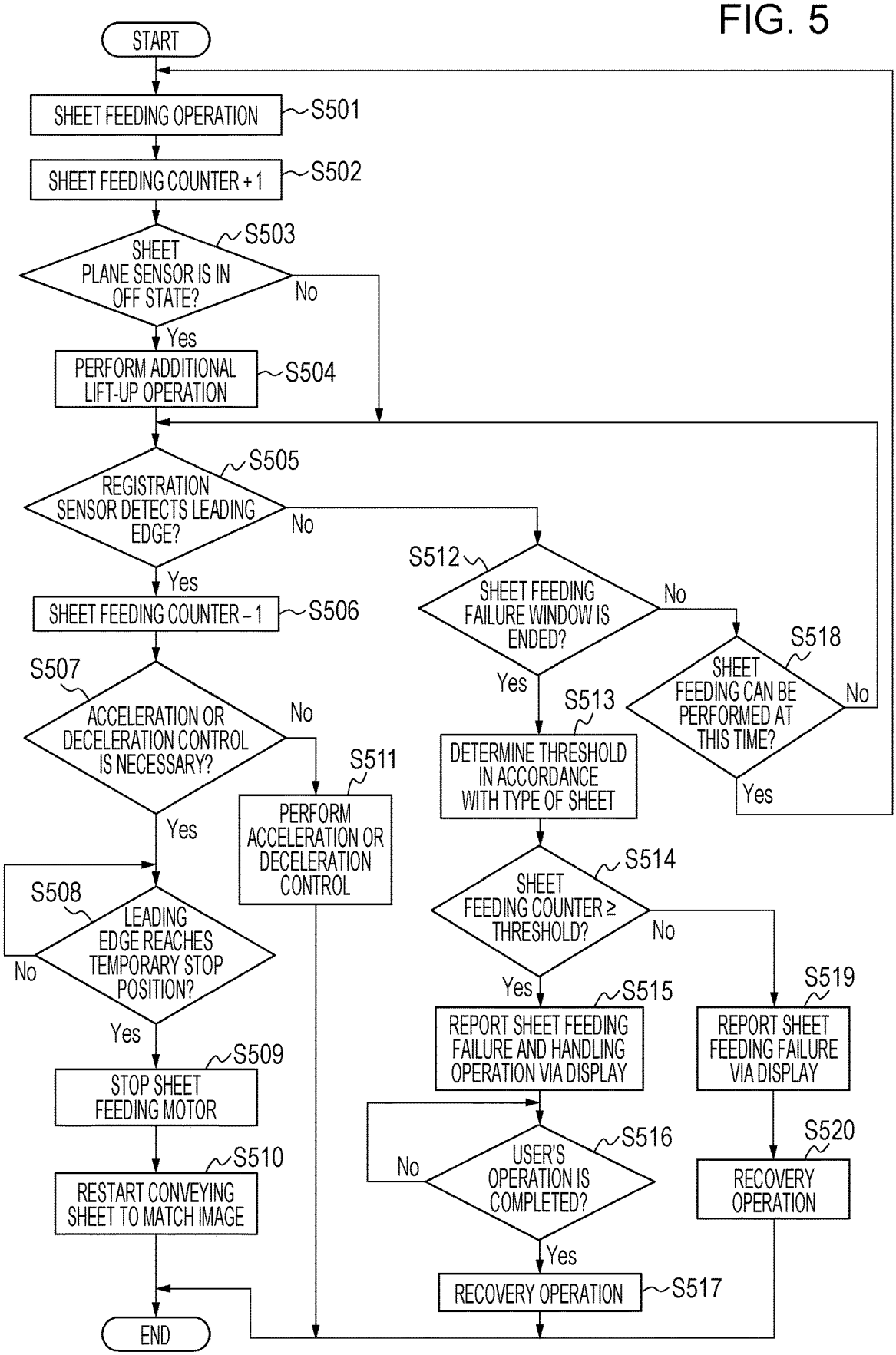
FIG. 5 is a flowchart when a feeding failure occurs in a second embodiment.

FIG. 5 is a flowchart of feeding control according to this embodiment. The control following the process illustrated as the flowchart in FIG. 5 is performed by the engine controller 202 in accordance with a program stored in a ROM or a RAM that are not illustrated in the drawing. The detailed description of the steps except for S503, S504, and S513 is omitted because they are identical to the corresponding steps in the first embodiment.

When the sheet feeding operation is started (S501), the sheet feeding conveyance control unit 215 performs a lift-up operation and then brings the pickup roller 17 into contact with the sheet of paper P. In S503, the sheet feeding conveyance control unit 215 determines whether the sheet plane sensor 40 can detect the sheet plane without any change. In the case in which the sheet plane sensor 40 cannot detect the sheet plane, it is assumed that the level of the sheet plane is lower than expected as the result of bringing the pickup roller 17 into contact with the sheet plane as described above. In this case, the sheet feeding conveyance control unit 215 performs an additional lift-up operation (S504).

In S513, the sheet feeding conveyance control unit 215 determines the threshold in accordance with the type of the sheet of paper P placed on the cassette 16. The type of the sheet placed on the cassette 16 is determined in accordance with the information about a user selection media received from the controller 201 via the video interface unit 210. In this embodiment, it is assumed that the information about the user selection media received from the controller 201 indicates envelope and the threshold is changed from 2 for plain paper to 4 for envelope. In S514, the threshold (4) that has been changed and the value of the sheet feeding counter are compared with each other, and accordingly, the details of the sheet feeding failure is determined as described above. Specifically, no pick-up is more likely to occur in the case of envelope compared to the case of plain paper, and therefore, the threshold, in accordance with which it is determined that the third case of sheet feeding delay jam occurs, is determined as a greater number than that of plain paper. Since the threshold in the case of envelope is 4, the sheet feeding operation illustrated in FIG. 3C is repeated twice.

As described above, in this embodiment, the condition of the sheet remaining inside the apparatus is more highly accurately calculated by changing the threshold in accordance with the type of the sheet of paper P and corresponding operations are performed accordingly, and as a result, the usability can be improved/refined.

While this embodiment describes the case in which the threshold is changed by using the information about a user selection media reported from the controller 201, the case should not be construed in a limiting sense. The threshold may be changed in accordance with, for example, the determination result of whether the type of the sheet of paper P placed on the cassette 16 is plain paper or envelope, which is determined by determining whether the sheet plane sensor 40 has entered in the OFF state as in S503 in the flowchart in FIG. 5.

Furthermore, while this embodiment describes the control in which the movable pickup roller 17 is brought into contact with the sheet of paper P after the lift-up operation, the configuration should not be construed in a limiting sense. When the information about the user selection media can be obtained anytime from the controller 201, the pickup roller 17 is not necessarily movable.

Moreover, while the first and second embodiments describe the configuration in which the sheet of paper P is fed from the cassette 16 attached to the main body of the printer 100 in an attachable and detachable manner, the configuration should not be construed in a limiting sense. The present disclosure can be applied to the configuration in which the sheet of paper P is fed from a manual feeding tray (not illustrated) attached to the main body of the printer 100 in a non-detachable manner. Here, the manual feeding tray is a stacking unit that is exposed outside the main body of the printer 100 and on which the sheet of paper P can be placed.

Further, the first and second embodiments describe the example of a laser beam printer, the image forming apparatus to which the present disclosure is applied is not limited to this example and may be a printer using another printing method, such as an ink jet printer, or a copier.

In the present disclosure, when a feeding failure has occurred, the condition of the sheet remaining inside the apparatus is calculated and a corresponding operation is performed accordingly, and as a result, the usability can be improved/refined.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-125008, filed Jun. 29, 2018, which is hereby incorporated by reference herein in its entirety.

What is claimed is:

1. An image forming apparatus comprising:

a stacking unit configured to stack a recording material;

a feeding unit configured to feed the recording material stacked on the stacking unit;

a first detection unit configured to detect the recording material fed by the feeding unit;

an image forming unit configured to form an image on the recording material fed by the feeding unit;

a determination unit configured to determine that a feeding failure has occurred when the first detection unit does not detect the recording material until a time when a predetermined period elapses since the feeding unit has started a feeding operation for the recording material;

a control unit configured to control the feeding operation for the recording material and to stop the feeding operation when the determination unit determines that the feeding failure has occurred;

a second detection unit configured to determine whether a topmost sheet of the recording materials placed on the stacking unit reaches a predetermined position; and a lift-up unit configured to lift up the recording materials placed on the stacking unit until the second detection unit detects the topmost sheet of the recording materials, wherein, in a case in which a state of the second detection unit is changed from a state of detecting the topmost sheet of the recording materials to a state of not detecting the topmost sheet of the recording materials as a result of bringing the feeding unit into contact with the topmost sheet of the recording materials after the lift-up unit lifts up the recording materials placed on the stacking unit, the control unit determines that the recording materials placed on the stacking unit are envelopes.

2. An image forming apparatus comprising:

a stacking unit configured to stack a recording material;

a feeding unit configured to feed the recording material stacked on the stacking unit;

a first detection unit configured to detect the recording material fed by the feeding unit;

an image forming unit configured to form an image on the recording material fed by the feeding unit;

a control unit configured to control a feeding operation for the recording material;

a second detection unit configured to determine whether a topmost sheet of the recording materials placed on the stacking unit reaches a predetermined position; and a lift-up unit configured to lift up the recording materials placed on the stacking unit until the second detection unit detects the topmost sheet of the recording materials, wherein, in a case in which a state of the second detection unit is changed from a state of detecting the topmost sheet of the recording materials to a state of not detecting the topmost sheet of the recording materials as a result of bringing the feeding unit into contact with the topmost sheet of the recording materials after the lift-up unit lifts up the recording materials placed on the stacking unit, the control unit determines that the recording materials placed on the stacking unit are envelopes.

3. The image forming apparatus according to claim 2, further comprising a determination unit configured to determine that a feeding failure has occurred when the first detection unit does not detect the recording material until a time when a predetermined period elapses since the feeding unit has started the feeding operation for the recording material.

4. The image forming apparatus according to claim 3, wherein the control unit is configured to stop the feeding operation when the determination unit determines that the feeding failure has occurred, wherein, in a case in which a number of times the feeding operation is performed that is counted by a count unit by a time when the feeding failure has occurred is smaller than a threshold, the control unit restarts the feeding operation that has been stopped and controls to have the image forming unit cleaned without waiting for an operation for the image forming apparatus from a user, and wherein, in a case in which the number of times the feeding operation is performed that is counted by the count unit by the time when the feeding failure has occurred is equal to or greater than the threshold, the control unit waits for the user's operation for the image forming apparatus while the feeding operation is stopped and controls not to clean the image forming unit while the feeding operation is stopped.

5. The image forming apparatus according to claim 4, wherein the control unit is configured to change the threshold in accordance with a type of the recording material placed on the stacking unit.

6. The image forming apparatus according to claim 5, wherein, in a case in which the recording material placed on the stacking unit is an envelope, the control unit sets the threshold as a number greater than a number used in a case in which the recording material placed on the stacking unit is a sheet of plain paper.

7. The image forming apparatus according to claim 6, wherein, when the first detection unit does not detect the recording material until the time when the predetermined period elapses since the feeding unit has started the feeding operation for the recording material, the control unit retries the feeding operation and the count unit counts the retrying of the feeding operation as the number of times the feeding operation is performed.

8. The image forming apparatus according to claim 6, further comprising a notification unit configured to suggest performing an operation, wherein, when the determination unit determines that the feeding failure has occurred in the case in which the number of times the feeding operation is performed that is counted by the count unit by the time when the feeding failure has occurred is smaller than the threshold, the notification unit does not suggest performing an operation for the image forming apparatus to the user, and wherein, in the case in which the number of times the feeding operation is performed that is counted by the count unit by the time when the feeding failure has occurred is equal to or greater than the threshold, the notification unit suggests performing the operation for the image forming apparatus to the user.

9. The image forming apparatus according to claim 8, wherein, when the determination unit determines that the feeding failure has occurred in the case in which the number of times the feeding operation is performed that is counted by the count unit by the time when the feeding failure has occurred is smaller than the threshold, the notification unit reports only information indicating that the feeding failure has occurred.

10. The image forming apparatus according to claim 8, wherein, when the determination unit determines that the feeding failure has occurred in the case in which the number of times the feeding operation is performed that is counted by the count unit by the time when the feeding failure has occurred is equal to or greater than the threshold, the notification unit reports information indicating that the feeding failure has occurred and reports information suggesting checking a placement condition of the recording material on the stacking unit.

* * * * *